US005647311A

United States Patent [19]

Liang et al.

[11] Patent Number: 5,647,311

[45] Date of Patent: Jul. 15, 1997

[54] ELECTROMECHANICALLY ACTUATED VALVE WITH MULTIPLE LIFTS AND SOFT LANDING

[75] Inventors: Feng Liang, Canton; Craig Hammann Stephan, Ann Arbor, both of Mich.

[73] Assignee: Ford Global Technologies, Inc., Dearborn, Mich.

[21] Appl. No.: 746,590

[22] Filed: Nov. 12, 1996

[51] Int. Cl.[6] ..... F01L 9/04

[52] U.S. Cl. ..... 123/90.11; 251/129.01; 251/129.16; 251/129.18

[58] Field of Search ..... 123/90.11, 90.15; 251/129.01, 129.05, 129.1, 129.15, 129.16, 129.18; 335/256, 258, 266, 268

[56] References Cited

U.S. PATENT DOCUMENTS

| | | | |
|---|---|---|---|
| 4,455,543 | 6/1984 | Pischinger et al. | 335/266 |
| 4,515,343 | 5/1985 | Pischinger et al. | 123/90.11 |
| 4,682,574 | 7/1987 | Kreuter | 123/90.11 |
| 4,715,330 | 12/1987 | Buchl | 123/90.11 |
| 4,715,332 | 12/1987 | Kreuter | 123/90.11 |
| 4,719,882 | 1/1988 | Kreuter | 123/90.11 |
| 4,777,915 | 10/1988 | Bonvallet | 123/90.11 |
| 4,831,973 | 5/1989 | Richeson, Jr. | 123/90.11 |
| 5,070,826 | 12/1991 | Kawamura | 123/90.11 |
| 5,074,259 | 12/1991 | Pusic | 123/90.11 |
| 5,095,856 | 3/1992 | Kawamura | 123/90.11 |
| 5,115,772 | 5/1992 | Kawamura | 123/90.11 |
| 5,131,624 | 7/1992 | Kreuter et al. | 251/129.18 |
| 5,222,714 | 6/1993 | Morinigo et al. | 251/129.16 |

FOREIGN PATENT DOCUMENTS

1121469 A 10/1984 U.S.S.R. .

*Primary Examiner*—Weilun Lo
*Attorney, Agent, or Firm*—Donald A. Wilkinson

[57] ABSTRACT

An electromechanically actuated valve (12) for use as an intake or exhaust valve in an internal combustion engine. The valve (12) is actuated by a electromechanical actuator assembly (18) which includes a first electromagnet (22), second electromagnet (30) and third electromagnet (32). A first disk (38) is mounted to the valve (12) in a gap between the second and third electromagnets, and a second disk (44) is slidably mounted to the valve (12) between an insert (17) and the first electromagnet (22). An extension (42) on the second electromagnet (30) extends to the second disk (44), allowing the second disk (44) to move the second electromagnet (30) relative to the third electromagnet (32), thereby changing the gap and thus the valve lift. A first spring (48), mounted between the second electromagnet (30) and first disk (38), and a second spring (50), mounted between the first disk (38) and an actuator housing (20), create an oscillatory system which drives most of the valve movement during engine operation, thus reducing power requirements to actuate the valves while increasing the responsiveness of the valves.

18 Claims, 3 Drawing Sheets

ELECTROMECHANICALLY ACTUATED VALVE WITH MULTIPLE LIFTS AND SOFT LANDING

FIELD OF THE INVENTION

The present invention relates to electromechanically actuated valves, and more particularly to intake and exhaust valves employed in an internal combustion engine.

BACKGROUND OF THE INVENTION

Conventional engine valves (intake or exhaust) used to control the flow into and out of the cylinders of internal combustion engines, are controlled by camshafts that fix the amount of lift as well as the opening and closing times of the valves relative to a crankshaft position. While this may be generally adequate, it is not optimal, since the ideal intake and exhaust valve timing and lift vary under varying operating conditions of the engine. Variable valve timing and lift can account for such conditions as throttling effect at idle, EGR overlap, etc., to substantially improve overall engine performance. Although some attempts have been made to allow for variable timing based upon adjustments in the camshaft rotation, this is still limited by the individual cam lobes themselves.

Consequently, some others have attempted to do away with camshafts altogether by individually actuating the engine valves by some type of electromechanical or electrohydraulic means. These systems have not generally proven successful, however, due to substantial costs, increased noise, reduced reliability, slow response time, or increased energy consumption of the systems themselves. Further, although some systems allow for extensive control of valve timing, they are limited as with the conventional camshaft systems to a single valve lift distance thus not fully taking advantage of engine efficiencies that can be had, or variable lift is achieved with degradation in valve performance.

One type of electromechanical system attempted employs simple solenoid actuators. But these have proven inadequate because they do not create enough magnetic force for speed needed to operate the valves without an inordinate amount of energy input. This is particularly true in light of the fact that the force profile is not desirable. The magnetic force increases as an armature disk approaches the electromagnet, causing a slap at end of stroke, creating noise and wear concerns, but not much force is available for acceleration at the beginning of the stroke, creating slow response time. Further, they are typically limited to a single amount of valve lift.

U.S. Pat. No. 5,222,714 attempts to overcome some of the deficiencies of an electromagnetic system by providing a spring to create an oscillating system about a neutral point wherein the spring is the main driving force during operation, and electromagnets provide holding forces in the opened and closed position, while also making up for frictional losses of the system. However, this system is still not able to fully utilize the possible efficiencies of the engine. A major drawback is that although this system allows for extensive control of valve timing, it is limited as with the conventional camshaft systems to a single valve lift distance, thus not fully taking advantage of engine efficiencies that can be had.

Furthermore, the system may still suffer from some undesirable effects not present in prior cam driven systems. For instance, since the electromagnets act on the plate, not the valve head, thermal expansion of the valve stem and manufacturing tolerances can mean that when the plate is in contact with the magnet, the valve may not be fully closed. One way to avoid this problem is for the plate to be designed so that even under the worst condition a gap remains between the magnet and plate, with a large gap at the other extreme of tolerances. To account for this possible large gap then, the current must be increased to hold the plate against the spring with the large gap, increasing energy consumption and heat of the system, and making the actual seating force unknown for any given assembly. Further, to assure closing of the engine valve head with these tolerances, the engine valve can seat with substantial velocity, resulting in unwanted noise and wear.

A consistent, known seating force is desirable for closing the engine valve in its valve seat. Further, it is also desirable for the system to take into account manufacturing tolerances and temperature variations without having to significantly increase the power consumption of the actuator.

Hence, a simple, reliable, fast yet energy efficient actuator for engine valves is desired, with the flexibility to vary both valve timing and lift to substantially improve engine performance, without degrading valve performance with varying lift.

SUMMARY OF THE INVENTION

In its embodiments, the present invention contemplates an engine valve assembly for an internal combustion engine having a cylinder head. The engine valve assembly includes an engine valve having a head portion and a stem portion, adapted to be slidably mounted within the cylinder head, and an actuator housing adapted to be mounted to the engine and surrounding a portion of the valve stem. A first electromagnet is fixedly mounted relative to the actuator housing, encircling a portion of the valve stem, a second electromagnet is slidably mounted relative to the actuator housing and encircling a portion of the valve stem farther from the head of the engine valve than the first electromagnet, with the second electromagnet including an extension portion extending toward the valve head radially inward from the first electromagnet, and a third electromagnet is fixedly mounted relative to the actuator housing and encircling a portion of the valve stem farther from the head of the engine valve than the second electromagnet and spaced from the second electromagnet to form a gap. A first disk operatively engages the engine valve stem, located between the second and third electromagnet, and a second disk slidably mounts to the engine valve stem, located nearer to the head of the engine valve than the first electromagnet and in contact with the extension portion. The engine valve assembly also includes first biasing means for biasing the first disk away from the second electromagnet, and second biasing means for biasing the first disk away from the third electromagnet.

Accordingly, an object of the present invention is to provide an electromechanically actuated engine valve having variable timing and lift which is capable of operating at speeds required by internal combustion engine operation, with minimal energy consumption.

An advantage of the present invention is the ability to provide multiple valve lifts through electromagnetic actuation, minimizing energy needed by using resonant mode behavior of a spring system, i.e., acceleration of the valve from rest and then deceleration to a low velocity, thus avoiding impacts among components, to reduce potential noise and wear concerns.

An additional advantage of the present invention is that it has a movable electromagnet which allows the equilibrium point of the oscillating spring system in the valve actuator to be adjusted to the middle of either a mid-open or a full open position; thus allowing for a two open position operation, but without sacrificing the resonant mode operation that will cause the valve to seat softly against the valve seat with minimal energy dissipation.

A further advantage of the present invention is that the actuator allows for a consistent, selectable closing force of the engine valve head against the valve seat, regardless of changes in valve length resulting from thermal expansions or manufacturing tolerances.

DETAILED DESCRIPTION OF THE PREFERRED EMBODIMENTS

Figure 1:
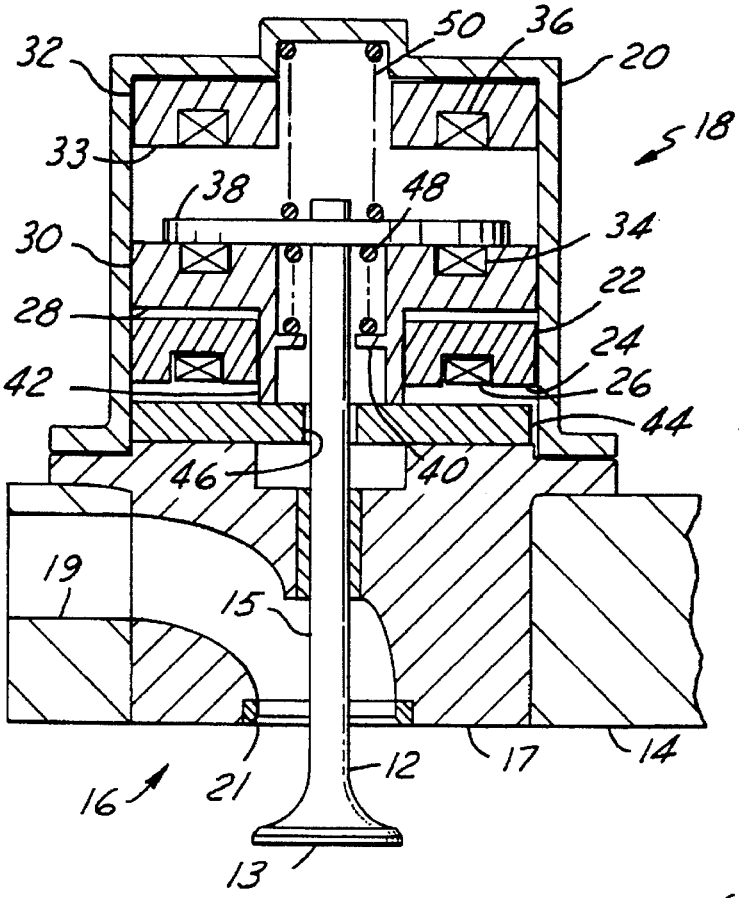
FIG. 1 is a schematic view of an engine valve assembly, with the valve shown in a fully open position, in accordance with the present invention.

FIG. 1 illustrates a first embodiment of the present invention. An engine valve 12, intake or exhaust as the case may be, is slidably mounted within an insert 17, secured in a cylinder head 14 of an internal combustion engine 16. The insert 17 and cylinder head 14 define a port 19, again either intake or exhaust, and a valve seat 21. The insert 17 allows for easier assembly of components into the cylinder head 14, and later servicing, as a module, but if preferred, the insert portion can be integral with the cylinder head 14.

The engine valve 12 includes a head portion 13, which seats against the valve seat 21 in its closed position, and a stem portion 15. This engine valve 12 controls the fluid flow into or out of a cylinder (not shown) within the engine 16.

An electromechanical actuator assembly 18 engages the valve stem portion 15 and drives the engine valve 12. The actuator assembly 18 includes a housing 20 mounted to the cylinder head insert 17, or cylinder head 14, if so desired. Within the housing 20 is mounted a first electromagnet 22, which is fixed relative to the housing 20. The first electromagnet 22 includes an annulus shaped core member 24, made of a magnetically conductive material, encircling a portion of the valve stem 15. The first electromagnet 22 also includes a first coil 26, extending circumferentially through the core member 24 forming an annulus shape near the lower surface of the core member 24.

An annulus shaped second core member 28, also made of a magnetically conductive material, is mounted in and can slide relative to the housing 20 and forms part of a second electromagnet 30. A second coil 34 extends circumferentially through the second core member 28 forming an annulus shape near the upper surface of the second core member 28. An extension member 42 of the second electromagnet 30 extends along the inside radial edge of the first electromagnet 22. Also, an annular protrusion 40 extends radially inward from the extension member 42.

A third electromagnet 32 includes a third core member 33, which is fixed relative to the housing 20. A third coil 36 extends circumferentially through the third core member 32 forming an annulus shape near the lower surface of the third core member 33. The three coils are connected to a conventional source of electrical current (not shown), which can be selectively turned on and off to each one independently by a conventional type of controller, such as an engine computer (not shown).

Mounted to the valve stem 15 is a ferrous, annular first disk 38, which is fixed relative to and moves with the stem 15. This first disk 38 is located between the upper surface of the second electromagnet 30 and the lower surface of the third electromagnet 32. A second annular disk 44 is mounted about the valve stem 15 below the first electromagnet 22. The second disk 44 includes a central circular hole 46, which has a larger diameter than the valve stem 15, allowing relative sliding movement between the second disk 44 and the valve stem 15. The extension member 42 is sized so that the second disk 44 can be in contact with the extension member 42 when there is still a gap between the first core 24 and second core 28.

A first spring 48 is mounted between the top surface of the annular protrusion 40 and the first disk 38, and a second spring 50 is mounted between the top surface of the first disk 38 and the actuator housing 20. The first and second springs 48, 50 are biased such that each counteracts the force of the other to cause the neutral or resting position of the engine valve 12 to be a partially opened position. These two springs have substantially identical spring constants and are positioned to hold the first disk 38 half-way between the second electromagnet 30 and the third electromagnet 32. This half-way position occurs, for instance, when the engine 16 is not operating, and thus, the electromagnets are not activated. By having this half-way position, an oscillating system can be created by the two springs during engine valve operation such that when the first disk 38 is released, by either electromagnet 30, 32, the force of the springs 48, 50 is such as to accelerate, then decelerate, the valve 12 so that, neglecting friction and length tolerances, the valve 12 comes to a stop at the other electromagnet 30, 32 without impact.

The operation of the electromechanical actuator 18 and resulting valve motion will now be described. To initiate valve opening from the neutral position, the coil 34 in the second electromagnet 30 is energized, causing the first disk 38 to be pulled downward towards it, compressing the first spring 48. Engine valve 12, as a result, is pulled to its open position, as is illustrated in FIG. 1. The second electromagnet 30 stays energized to hold this position against the bias of the first spring 48. The compressed spring 48 now stores potential energy for the oscillating system which will drive most of the engine valve movement during engine operation.

To begin to close the engine valve 12, the second electromagnet 30 is de-energized, allowing the first spring 48 to push the first disk 38 upward. To finish closing the engine valve 12 and hold it there, the third coil 36 is energized, causing the first disk 38 to be pulled upward towards it by magnetic force. As a result of this, the first disk 38 compresses the second spring 50. The third electromagnet 32 stays energized to hold the engine valve 12 in the closed position against the bias of the second spring 50.

The oscillating type of system described herein creates a situation where the work done by the electromagnets is mostly used to hold the valve 12 in a particular position, while most of the work of moving the valve 12 is done by the springs. Only a small portion of the work of moving the valve 12 is done by the electromagnets, to make up for friction effects and other energy losses in the system. In this way, the energy needed to drive this electromagnetic actuator 18 is minimized.

In order to operate the engine valve 12 in its mid-open position mode, the first electromagnet 22 is energized. This causes the second disk 44 to be pulled toward the first electromagnet 22. As a result, the second disk 44 pushes up on the extension member 42, lifting the second electromagnet 30 toward the third electromagnet 32, against the bias of the first and second springs 48, 50. The second electromagnet 30 causes the first and second springs 48, 50 to be compressed by an equal amount. Thus, the equilibrium point of engine valve 12 is still in the center of the now narrower gap between these electromagnets. The second and third electromagnets 30, 32 operate the same as with the full open mode, but with the valve traveling through a shorter distance.

In this way, the valve 12 still oscillates between the closed position and mid-open position, coming to a controlled stop at each end of its stroke. The mid-open position can be any fraction of the full open position depending upon the characteristics and operating conditions desired of the particular engine. Moreover, the second electromagnet 30 moves only once during each switch between full and mid-open operation, minimizing the significance of any noise or wear concerns resulting from impact of the second disk 44 against the first electromagnet 22.

To begin to open the valve 12 from the closed position, the third coil 36 is de-energized, allowing the second spring 50 to push the engine valve 12 downward. The second electromagnet 30 is energized to pull the first disk 38 downward and lock the valve 12 in its open position. This is the same procedure for both full and mid-open positions.

By utilizing the resonance of the two springs in the actuator 18 to accomplish much of the movement, the response time is improved over merely providing electromagnets, and with less power consumption. Further, the springs allow for a system with softer landings, for the closed and two open positions, than a pure electromagnet actuated system, thus reducing the noise that otherwise may be generated. The multiple valve lifts are also determined by simple on/off commands of the electromagnets rather than attempting to precisely adjust and control the electric current used to power the magnets or other complex means that may be used to create mid-opened positions.

Figure 2:
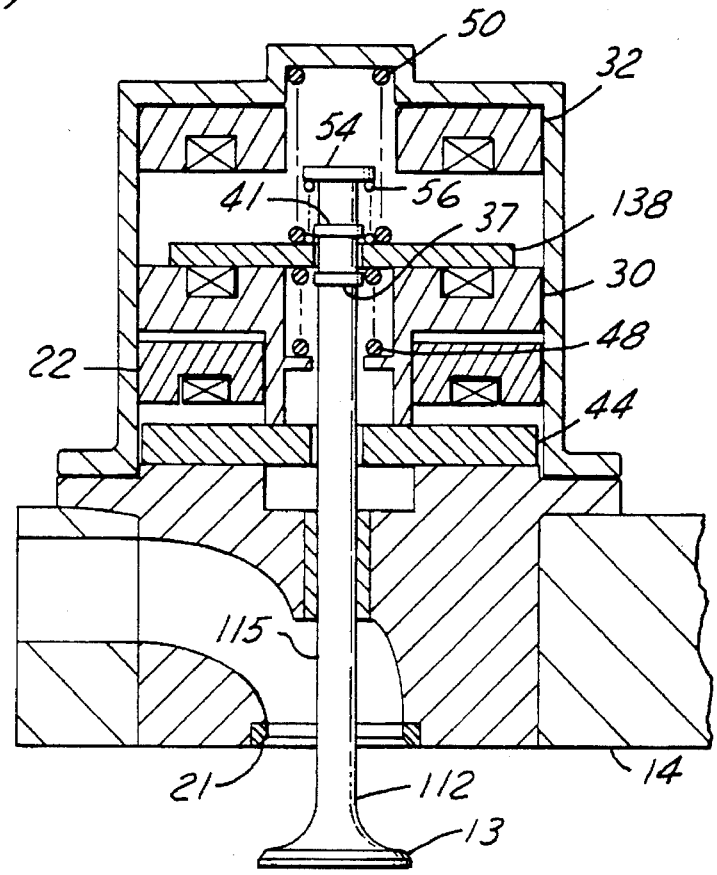
FIG. 2 is a schematic view similar to FIG. 1, but illustrating a second embodiment of the present invention.

A second embodiment of the present invention is illustrated in FIG. 2. This embodiment is the same as the first embodiment, with an additional soft landing feature incorporated into the actuator to account for manufacturing tolerances and temperature variations, while assuring the desired seating force is accomplished. In this embodiment, like elements with the first embodiment will be similarly designated, while changed elements will also be similarly designated but with 100-series designations. The first disk 138 is slidably mounted on the valve stem 115. Mounted on and fixed relative to the valve stem 115 are two stops, a lower stop 37 and an upper stop 41. The first disk 138 is free to slide between two stops 37, 41 on the valve stem 115. The sliding joint formed between the first disk 138 and valve stem 115 is lubricated by the same source conventionally supplying oil to the other sliding portions of the engine valve 112.

The stops 37, 41 are located sufficiently far apart that with the valve fully closed and the first disk 138 seated against the third electromagnet 32, the first disk 138 is positioned between the two stops 37, 41 under substantially all conditions of temperature and manufacturing tolerances.

A spring stop 54 is affixed to the valve stem 115 above the upper stop 41. The first disk 138 is biased toward the lower stop 37 by an additional smaller secondary spring 56 confined between the first disk 138 and the spring stop 54. This spring is sized and preloaded to produce the desired holding force when the valve is closed. The spring stop 54 can be located as desired, but should be far enough above the upper stop 41 that the force of the preloaded secondary spring 56 does not vary appreciably (relative to the requirements for closing force) when the first disk 138 moves between the lower stop 37 and upper stop 41.

This operation is similar to the first embodiment. Nonetheless, the process is somewhat different. For example, in beginning valve closing, the second electromagnet 30 is de-energized. This allows the first spring 48 to push up on the first disk 138, against the force of the secondary spring 56, to the upper stop 41, accelerating the engine valve 112 upwards against the force of the second spring 50. Further, the third electromagnet 32 is energized, creating a magnetic force pulling the first disk 138 upward. As the engine valve 112 moves the second spring 50 increasingly resists the valve motion as it is compressed. This allows the secondary spring 56 to push on the spring stop 54, moving the valve stem 115 upwards with respect to the disk 138 until it reaches the lower stop 37. At touchdown, the force of the second spring 50, in combination with any damping (not shown) if so desired, has brought the velocity of the valve stem 115 close to zero.

With the valve head 13 against the seat 21, the attractive force of the third electromagnet 32 continues to pull the first disk 138 upwards against the force of the second spring 50 and secondary spring 56. The first disk 138 actually contacts the third electromagnet 32 before it reaches the upper stop 41. The force transferred to the valve stem 115 is that of the secondary spring 56. Once the contact of the first disk 138 to the third electromagnet 32 is made, current through the electromagnet 32 is reduced to a low level, sufficient to hold the disk 138 in this position.

The secondary spring 56 exerts a consistent known force on the valve 112 when it is closed against its seat 21. In addition, since the third electromagnet 32 couples to the valve 112 only through the secondary spring 56, the impact of the valve head 13 on its seat 21 will be low. Further, since the first disk 138 is in actual contact with one of the electromagnets in both the open and closed valve positions, the attractive magnetic field force required is maximized and so energy consumption is minimized.

Figure 3:
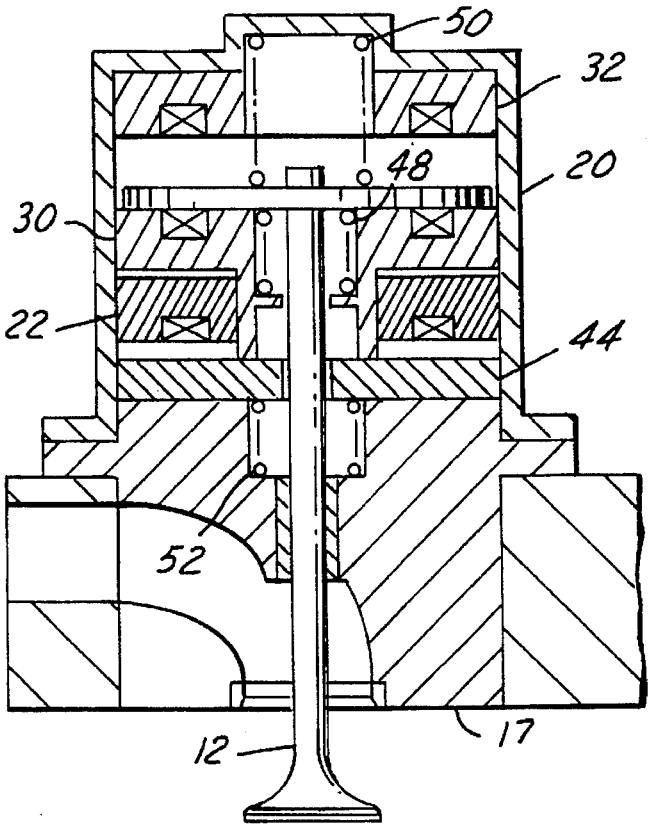
FIG. 3 is a schematic view similar to FIG. 1, but illustrating a third embodiment of the present invention.

A third embodiment of the present invention is illustrated in FIG. 3. This embodiment is the same as the first embodiment, but with the addition of a spring. A third spring 52 is compressed between the insert 17 and the second disk 44. The purpose of this third spring 52 is to oppose the downward force on the second disk 44 generated by the first and second springs 48, 50. As such, the third spring 52 is calibrated so as to provide an upward force just slightly less than the downward force of the first and second springs 48, 50 when the second disk 44 is fully seated on the insert 17. Consequently, the first electromagnet 22 needs to exert only a minimal force to draw the second disk 44 upward, allowing the first electromagnet to be smaller than the first embodiment. Additionally, the soft landing feature of the second embodiment can be incorporated into this embodiment also.

Figure 4:
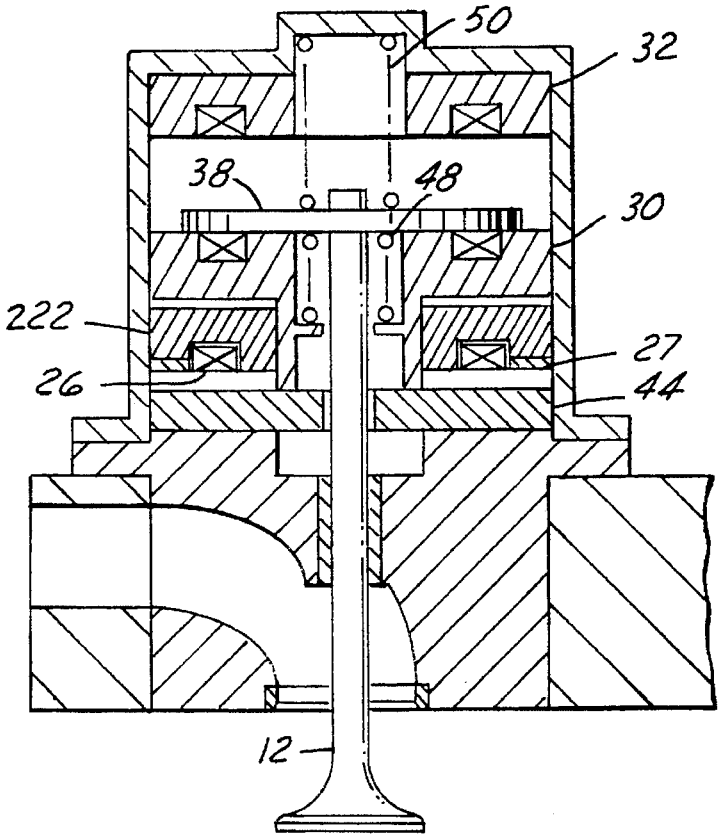
FIG. 4 is a schematic view similar to FIG. 1, but illustrating a fourth embodiment of the present invention.

A fourth embodiment of the present invention is illustrated in FIG. 4. In this embodiment, like elements with the first embodiment will be similarly designated, while changed elements will also be similarly designated but with 200-series designations. This embodiment is the same as the first embodiment, but with the addition of an annulus shaped permanent magnet 27 located radially outward from the first coil 26. The permanent magnet 27 is embedded in the flux path of the first electromagnet 222. In order to switch from full open to mid-open mode, then, the first electromagnet 222 is energized and pulls the second disk 44 upward until it the two are in contact. Then, the permanent magnet 27 will hold the second disk 44 against the first electromagnet 222. The first electromagnet 222 may also be energized to a low level if needed to assist the permanent magnet 27. This depends upon the size of the permanent magnet 27 and the spring force exerted by the first and second springs 48, 50. In order to release the second disk 44, a pulse of current is once again applied to the first coil 26, but this time in a direction such as to cancel the flux from the permanent magnet 27.

Figure 5:
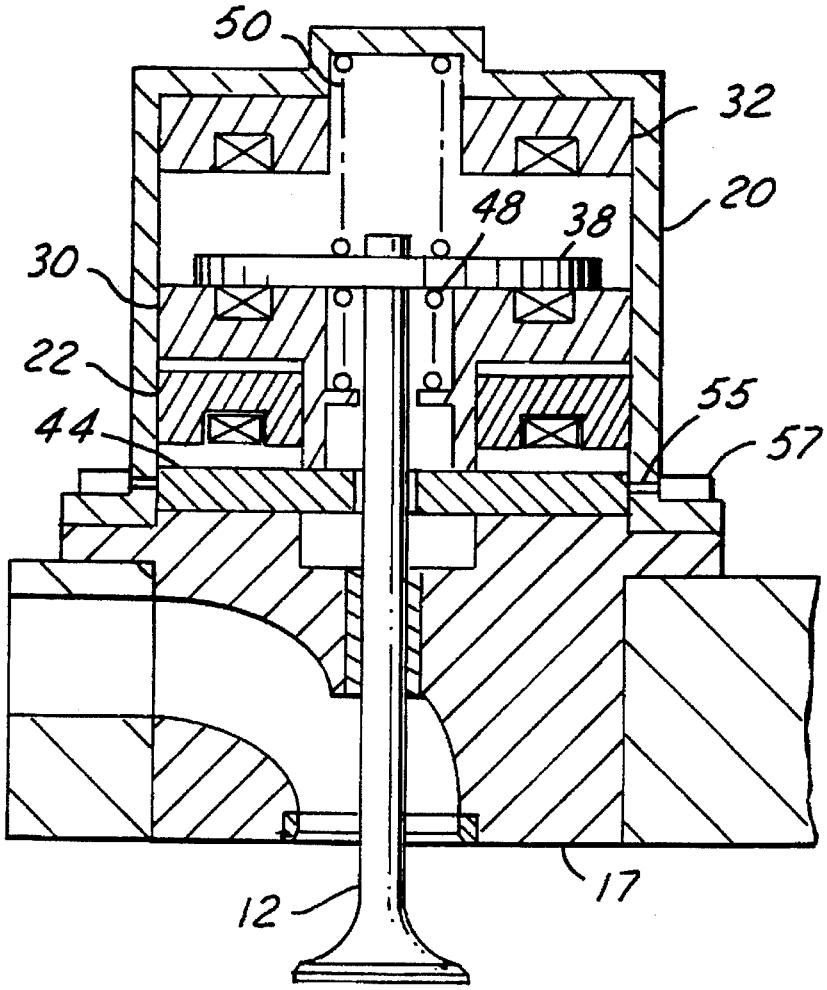
FIG. 5 is a schematic view similar to FIG. 1, but illustrating a fifth embodiment of the present invention.

A fifth embodiment of the present invention is illustrated in FIG. 5. This embodiment is the same as the first embodiment, but with the addition of spring loaded pins 55 and corresponding solenoid actuators 57 which are mounted to the housing 20. The solenoids 57 are electrically connected to a conventional source of electric current (not shown), which can be selectively turned on and off by a conventional controller, such as an engine computer (not shown). The pins 55 act as a stop to hold the second disk 44 in position once the first electromagnet 22 has drawn the second disk 44 upward. To release the second disk 44, the solenoids 57 are pulsed to briefly withdraw the pins 55, allowing the second disk 44 to slide down to the insert 17, for full open valve operation.

While certain embodiments of the present invention have been described in detail, those familiar with the art to which this invention relates will recognize various alternative designs and embodiments for practicing the invention as defined by the following claims.

What is claimed is:

1. An engine valve assembly for an internal combustion engine having a cylinder head, the engine valve assembly comprising:

an engine valve having a head portion and a stem portion, adapted to be slidably mounted within the cylinder head;

an actuator housing adapted to be mounted to the engine and surrounding a portion of the valve stem;

a first electromagnet, fixedly mounted relative to the actuator housing and encircling a portion of the valve stem;

a second electromagnet, slidably mounted relative to the actuator housing and encircling a portion of the valve stem farther from the head of the engine valve than the first electromagnet, with the second electromagnet including an extension portion extending toward the valve head radially inward from the first electromagnet;

a third electromagnet, fixedly mounted relative to the actuator housing and encircling a portion of the valve stem farther from the head of the engine valve than the second electromagnet and spaced from the second electromagnet to form a gap;

a first disk operatively engaging the engine valve stem and located between the second and third electromagnet;

a second disk slidably mounted to the engine valve stem and located nearer to the head of the engine valve than the first electromagnet and in contact with the extension portion;

first biasing means for biasing the first disk away from the second electromagnet; and second biasing means for biasing the first disk away from the third electromagnet.

2. The engine valve assembly of claim 1 wherein the first biasing means is a spring mounted between the first disk and the second electromagnet.

3. The engine valve assembly of claim 2 wherein the second biasing means is a spring mounted between the first disk and the actuator housing.

4. The engine valve assembly of claim 3 wherein the first disk is fixedly mounted to the engine valve stem.

5. The engine valve assembly of claim 4 further including a third biasing means for biasing the second disk toward the first electromagnet.

6. The engine valve assembly of claim 3 wherein the first disk is slidably mounted to the engine valve stem and the engine valve assembly further includes stop means for limiting the sliding of the first disk along the valve stem toward the engine valve head to a predetermined location on the valve stem, and secondary biasing means for biasing the first disk toward the stop means.

7. The engine valve assembly of claim 6 wherein the stop means further comprises limiting the sliding of the first disk along the valve stem away from the engine valve head to a predetermined location on the valve stem.

8. The engine valve assembly of claim 7 wherein the stop means is a first and a second stop, each fixedly mounted to the engine valve stem, with the first stop located between the first disk an the engine valve head and the second stop located on the opposite side of the first disk from the first stop, with both stops shaped limit the sliding travel of the first disk along the valve stem.

9. The engine valve assembly of claim 8 wherein the secondary biasing means includes a spring stop fixedly mounted to the valve stem farther from the first stop than from the second stop and a secondary spring mounted about the valve stem between the spring stop and the first disk, with the secondary spring biasing the first disk toward the first stop.

10. The engine valve assembly of claim 1 wherein the first electromagnet includes a permanent magnet mounted therein adjacent to the second disk.

11. The engine valve assembly of claim 1 further including a pin protruding through the housing closer to the engine valve head than the first electromagnet and including a solenoid valve mounted to the pin, whereby the solenoid valve can selectively retract the pin.

12. The engine valve assembly of claim 1 further including a third biasing means for biasing the second disk toward the first electromagnet.

13. An internal combustion engine for use in a vehicle comprising:

a cylinder head;

an engine valve having a head portion and a stem portion, slidably mounted within the cylinder head;

an actuator housing mounted to the engine and surrounding a portion of the valve stem;

a first electromagnet, fixedly mounted relative to the actuator housing and encircling a portion of the valve stem;

a second electromagnet, slidably mounted relative to the actuator housing and encircling a portion of the valve stem farther from the head of the engine valve than the first electromagnet, with the second electromagnet including an extension portion extending toward the valve head radially inward from the first electromagnet;

a third electromagnet, fixedly mounted relative to the actuator housing and encircling a portion of the valve stem farther from the head of the engine valve than the second electromagnet and spaced from the second electromagnet to form a gap;

a first disk operatively engaging the engine valve stem and located between the second and third electromagnet;

a second disk slidably mounted to the engine valve stem and located nearer to the head of the engine valve than the first electromagnet and in contact with the extension portion;

a spring mounted between the first disk and the second electromagnet for biasing the first disk away from the second electromagnet; and an opposed spring mounted between the first disk and the actuator housing for biasing the first disk away from the third electromagnet.

14. The engine of claim 13 wherein the cylinder head comprises a valve cavity and an insert member mounted within the cavity, with the engine valve slidably mounted within the insert.

15. The engine of claim 14 further including a third spring mounted between the insert and the second disk for biasing the second disk toward the first electromagnet.

16. The engine of claim 15 wherein the first disk is slidably mounted to the engine valve stem and the engine valve assembly further includes stop means for limiting the sliding of the first disk along the valve stem toward the engine valve head to a predetermined location on the valve stem, and secondary biasing means for biasing the first disk toward the stop means.

17. The engine of claim 13 wherein the first disk is fixedly mounted to the engine valve stem.

18. The engine of claim 17 wherein the first electromagnet includes a permanent magnet mounted therein adjacent to the second disk.

* * * * *